US005378169A

United States Patent [19]

Volz et al.

[11] Patent Number: 5,378,169

[45] Date of Patent: Jan. 3, 1995

[54] PIVOTAL CONNECTOR FOR PLANAR ELECTRONIC DEVICES

[75] Inventors: Keith L. Volz, Jamestown; Robert D. Irlbeck, Greensboro; Robert M. Renn, Pfafftown; David C. Johnson, Winston-Salem; Frederick R. Deak, Kernersville, all of N.C.

[73] Assignee: The Whitaker Corporation, Wilmington, Del.

[21] Appl. No.: 126,848

[22] Filed: Sep. 24, 1993

[51] Int. Cl.[6] ..... H01R 23/68

[52] U.S. Cl. ..... 439/376; 439/924

[58] Field of Search ..... 439/924, 74, 326, 341, 439/66, 67, 376

[56] References Cited

U.S. PATENT DOCUMENTS

| | | | |
|---|---|---|---|
| 3,985,413 | 10/1976 | Evans | 439/66 |
| 4,057,311 | 11/1977 | Evans | 439/66 |
| 4,503,608 | 3/1985 | Evans | 439/924 |
| 4,678,252 | 7/1987 | Moore | 439/62 |
| 4,869,681 | 9/1989 | Vache et al. | 439/924 |
| 5,032,087 | 7/1991 | Koiner et al. | 439/341 |
| 5,052,942 | 10/1991 | Rauterberg et al. | 439/326 |
| 5,066,236 | 11/1991 | Broeksteeg | 439/608 |
| 5,088,929 | 2/1992 | Enomoto | 439/66 |
| 5,224,873 | 7/1993 | Duffet et al. | 439/326 |
| 5,268,820 | 12/1993 | Tseng et al. | 361/785 |

FOREIGN PATENT DOCUMENTS

| | | | |
|---|---|---|---|
| 3735928 | 5/1989 | Germany | 439/341 |
| 52-43838 | 10/1977 | Japan | 439/924 |

*Primary Examiner*—Gary F. Paumen

*Attorney, Agent, or Firm*—William B. Noll

[57] ABSTRACT

This invention is directed to an electrical connector for sequentially connecting plural contacts provided along the respective mating surfaces of a pair of planar electronic devices, where the devices are joined to or mounted within a pair of pivotally arranged housing members. The connector comprises a first housing mounted to one of the planar devices, such as a mother board, where first housing includes an open end and a closed end, and a second housing mounting the other planar electronic device, such as a daughter board, second housing includes an open end and a closed end, and that the respective closed ends include cooperative means for hingely engaging each other. By this arrangement, as the planar electronic devices are pivotally moved about the cooperative means from a nonparallel position to a parallel position of electrical engagement, the respective plural contacts between the planar electronic devices enter into engagement in a sequentially predetermined order.

12 Claims, 9 Drawing Sheets

PIVOTAL CONNECTOR FOR PLANAR ELECTRONIC DEVICES

BACKGROUND OF THE INVENTION

This invention is directed to an electrical connector for sequentially connecting plural contacts provided along the respective mating surfaces of a pair of planar electronic devices, such as a mother board and a daughter board.

U.S. Pat. No. 4,678,252 to Moore represents an early attempt at providing a two-stage connection between a pair of planar devices. The connector thereof includes an angled insulator having first and second legs which form a pie-shaped cavity at their meeting point. The cavity extends for a distance necessary to receive one edge of one the planar devices. The cavity is such that the planar device can be moved through an arc commencing with a position parallel to the first leg. Flexible spring metal contacts form a portion of the first leg so that electrical contact portions of the planar device make contact with the resilient spring metal contacts when the planar device is in the position parallel to the first leg. The second leg forms an alignment surface for abutting the surface of the planar device opposite the electrical contacts, and the first leg forms a fulcrum about which the planar device is pivoted. The planar device is pivoted to a position whereby such device is parallel to the other planar device, i.e., mother board. Here the pivoted device comes to rest on a second electrical connector, where such connector includes resilient spring metal contacts. In this position, the respective contacts, electrically interconnect the two, parallelly aligned, planar electronic devices.

U.S. Pat. No. 4,057,311 to Evans teaches an electrical connector for electrically interconnecting a pair of spaced apart, planar electronic devices, such as printed circuit boards, by the use of an intermediate housing body containing a flexible film having electrical circuitry thereon, which film is typically supported by an elastomeric body. Such flexible film is sold commercially under the trademark, AMPLIFLEX, owned by The Whitaker Corporation, Wilmington, DE. As disclosed by Evans, the elastomeric bodies and the flexible circuits can be manufactured in accordance with the teachings of U.S. Pat. No. 3,985,413 which teaches the use of a material such as silicone rubber for the body members and a suitable polyamide film for the flexible circuit. The conductors on the flexible circuit are preferably produced by etching and are advantageously extremely narrow to allow for high density connections.

The present invention, by the preferred use of an AMPLIFLEX type interconnection system, and a unique structural design, offers many features and benefits, such as a user friendly system, modular versatility, high density, excellent signal integrity, low insertion forces, contact sequencing, high cycle life, low profile, and redundant contact points. Such features and benefits will become more apparent in the description which follows, particularly when read in conjunction with the accompanying drawings.

SUMMARY OF THE INVENTION

The invention relates to an electrical connector for sequentially connecting plural contacts provided along the respective mating surfaces of a pair of planar electronic devices, such as printed circuit boards, or more precisely, a mother board, daughter board arrangement. The connector of this invention comprises a first housing mounted to one of the planar devices, where the first housing includes an open end and a closed end, and a second housing mounting the other planar electronic device, where the second housing includes an open end and a closed end, and that the respective closed ends include cooperative means for hingedly engaging each other. With such means operatively connected, the second housing, with its planar electronic device mounted therein, is pivotally moved thereabout from a nonparallel position to a parallel position with the first housing. As the second housing is moved, the respective plural contacts between the planar electronic devices enter into engagement in a connector hereof further includes alignment and latching sequentially predetermined order. The electrical means.

BRIEF DESCRIPTION OF DRAWINGS

FIGS. 13*a* to 13*b* are partial sectional views illustrating the sequence for mating the cover member to the base assembly.

DETAILED DESCRIPTION OF PREFERRED EMBODIMENTS

The present invention is directed to an electrical connector 10, illustrated in the several Figures, for sequentially connecting plural contacts provided along the respective mating surfaces of a pair of planar electronic devices, such as a mother board 12 and a daughter board 14, preferably where a single mother board 12 is electrically interconnected to plural daughter boards 14, or modular units, which perform a variety of functions for a computer, by way of example.

Figure 1:
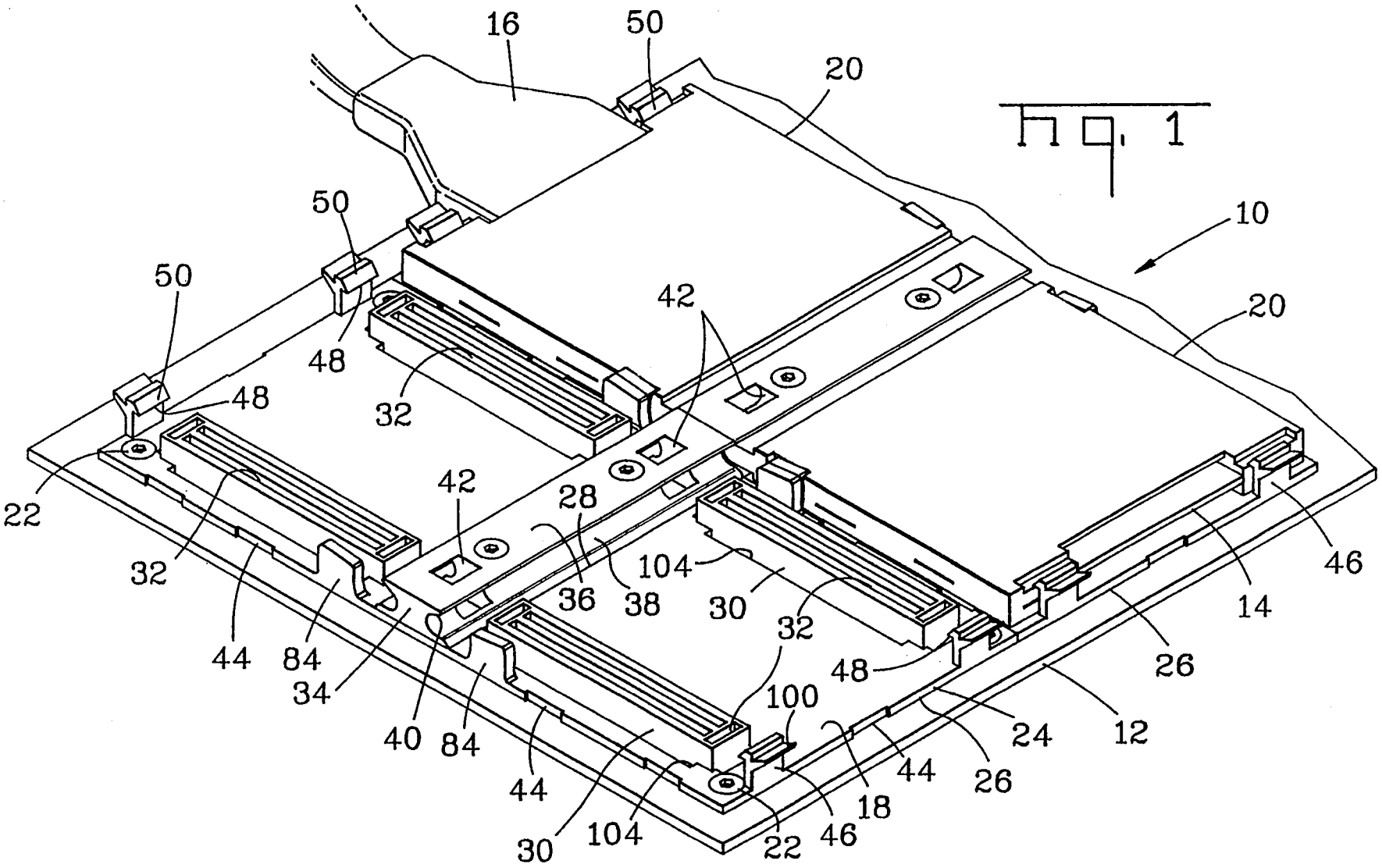
FIG. 1 is a perspective view of a preferred of a preferred embodiment of this invention showing a pair of mated connectors, one showing mating by an externally applied I/O connector, and a pair of base assemblies which comprise the lower housing members for the connectors hereof, where such connectors and base assemblies are shown mounted to a single planar electronic device, such as a mother board.

FIG. 1 illustrates the connector assembly showing two assembled modular units, one with an I/O connector 16 secured thereto, and two base assemblies 18 without the daughter board mounting cover member 20. The base assembly 18, shown mounted to the mother board 12 by fastening means 22, comprises a base 24 having an open end 26 and a closed end 28. Upstanding from said base are a pair of contact retaining members 30, where such members contain plural through openings or cavities 32 oriented in a longitudinal or traverse directions, the reasons for which will be explained hereinafter.

The closed end 28 comprises an upstanding housing member 34, which may be for a single modular unit or double, i.e. back-to-back, as shown in FIG. 1, having a top wall 36. The side or sides of the housing member 34, depending on whether it is to serve a single or two modular units, include a transverse slot or groove 38, where the upper edge 40 is angled, such as about 45° to the plane of the mother board 12. This, as will be apparent hereinafter, will allow the angular entry of the daughter board mounted housing or cover member 20 into the slot 38.

Disposed along the top wall 36 are a pair of cover guide cavities 42 which are in communication with the slot 38. It will be apparent from the description which follows that the cavities 42 and slot 38 cooperate with the cover member 20 to effect its mounting to the base assembly 18, and its rotative movement relative thereto.

About the periphery of the base assembly 18 one or more indents or cutouts 44 are provided to receive corresponding tabs from a ground shielding member, as hereinafter explained. Additionally, a pair of upstanding latching members 46 have been included to receive in latching engagement the cover member in the fully mated position. The latching member 46, formed of plastic or metal, is designed with a horizontally disposed shoulder 48 and a tapered side 50. It will be understood, particularly from the further description which follows, that as the cover member 20 is lowered onto the base assembly 18, the cover member 20 initially contacts the tapered side 50 causing the latch member to yield or flex about its base thereby allowing the cover member 20 to seat in a position to electrically interconnect with the mother board 12 through the base assembly 18. In this position, the latching member 46 resiles to its normal upstanding position with the shoulder 48 engaging the cover member 20.

Figure 5:
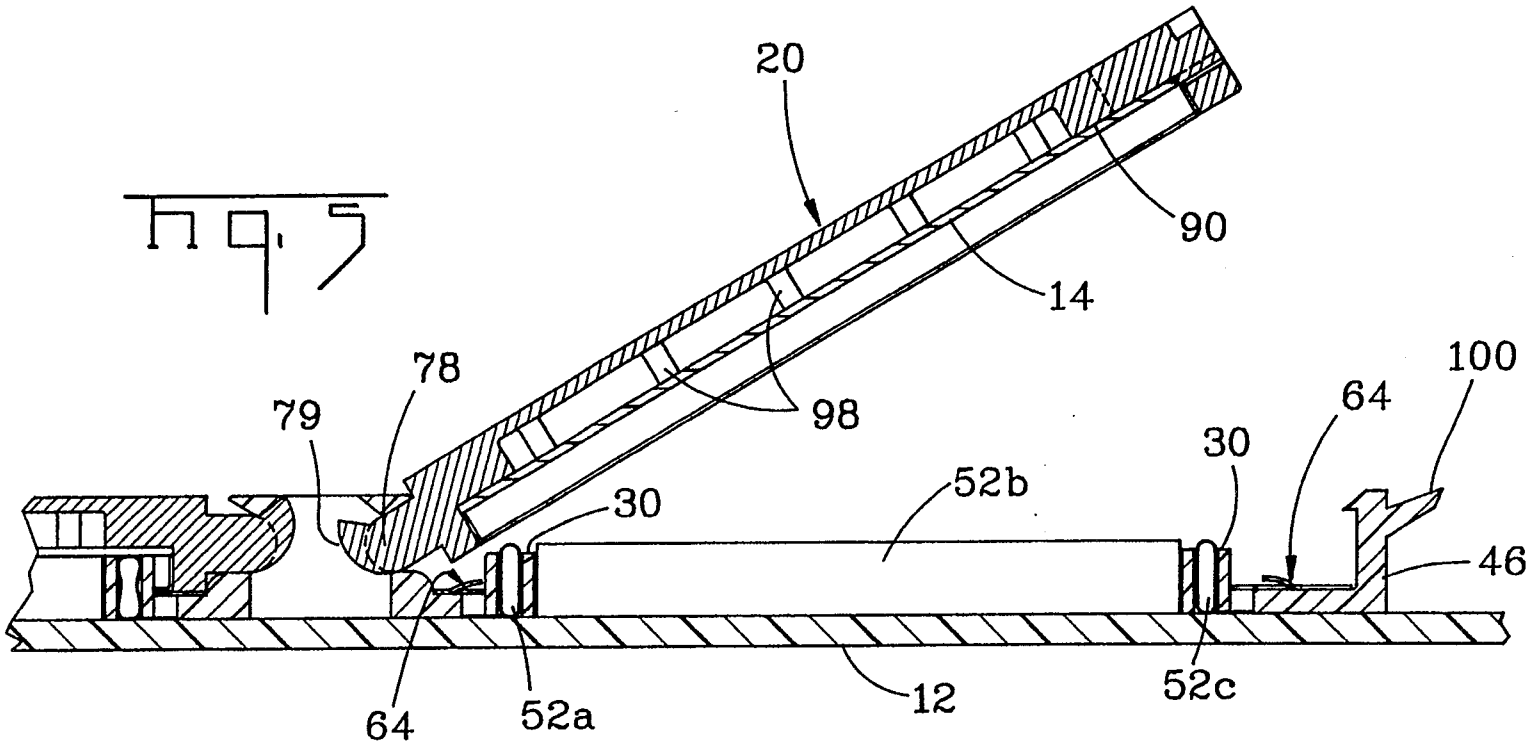
FIG. 5 is a longitudinal sectional view taken through the unmated connector of FIG. 1.
Figure 6:
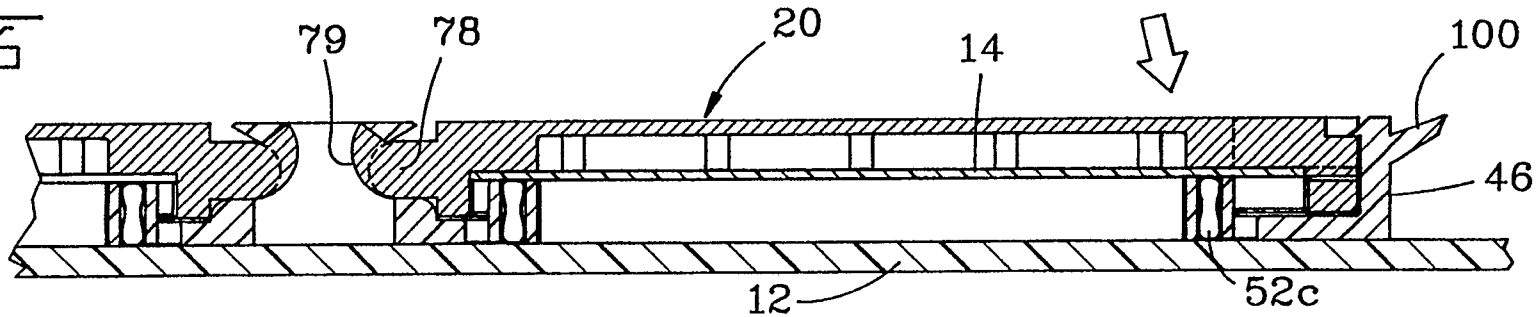
FIG. 6 is a longitudinal sectional view, similar to FIG. 5, showing a mated connector according to this invention.
Figure 7:
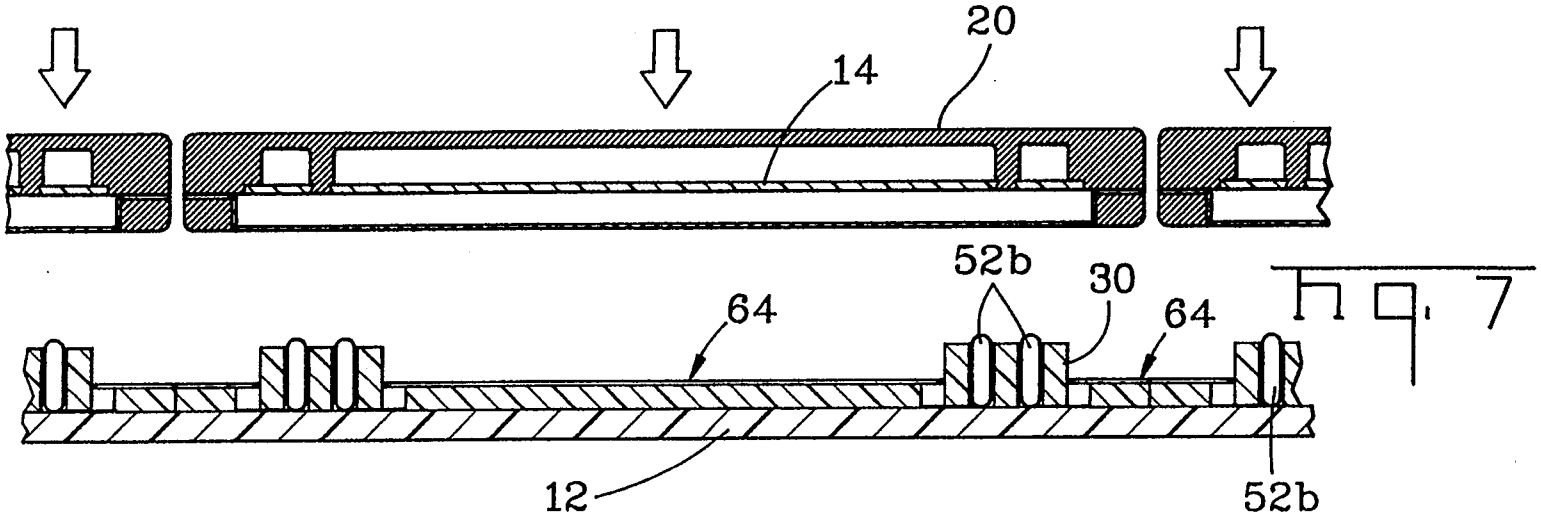
FIG. 7 is an exploded, transverse sectional view of the connector hereof in a premating position.
Figure 8:
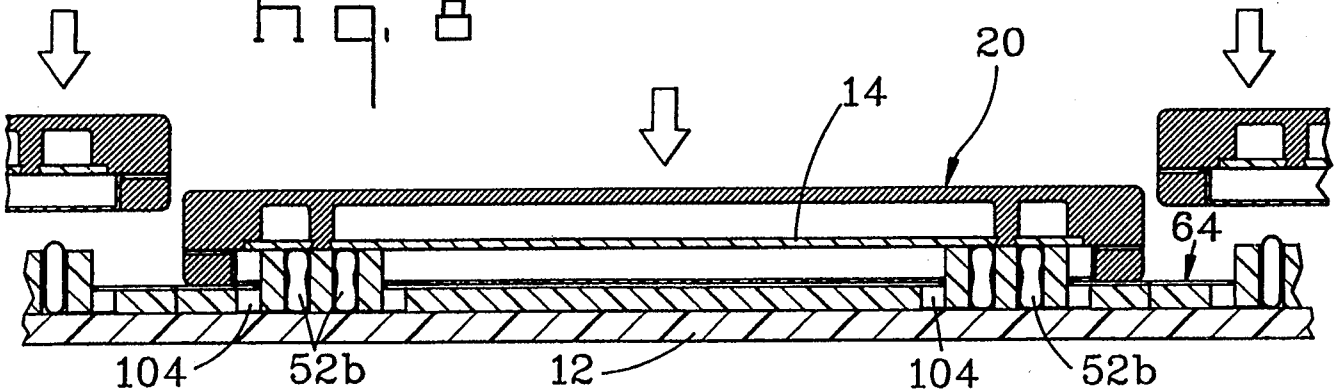
FIG. 8 is a transverse sectional view similar no FIG. 7, showing the mated connector.

FIGS. 5–8, among other features, illustrates the manner by which a flexible film member 52, having electrical circuitry thereon, is provided in each of the through openings 32 in the contact retaining members 30. FIGS. 6 and 8 show the film member 52 compressed between and in electrical contact with the mother board 12 and daughter board 14. The sequencing features of the connector of this invention will be described in more detail hereinafter.

Figure 2:
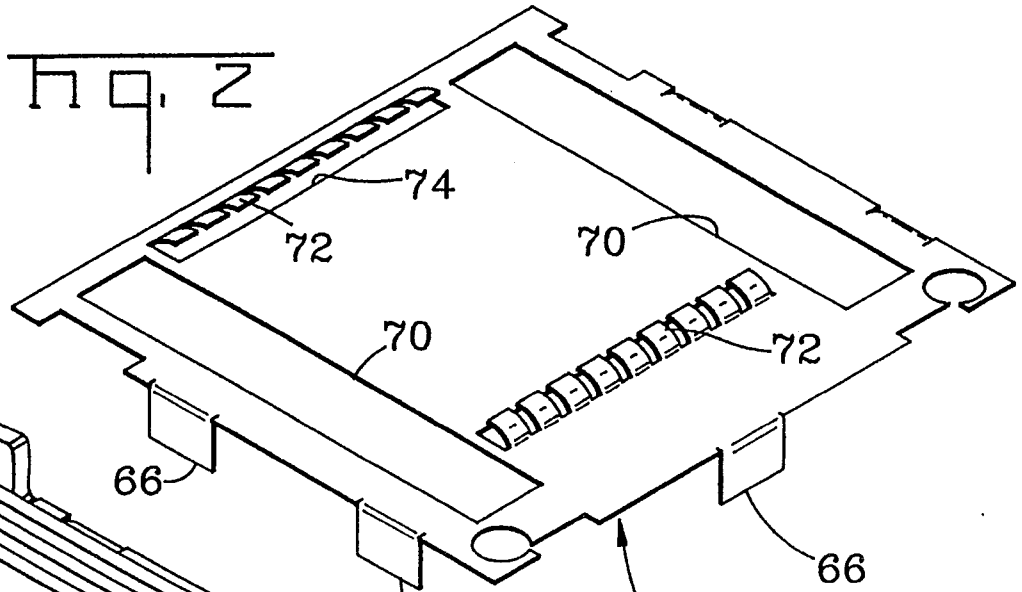
FIG. 2 is a perspective view of a grounding shield member which lies contiguous with the base assembly, where said shield member is typically stamped and formed from a sheet metal blank.
Figure 3:
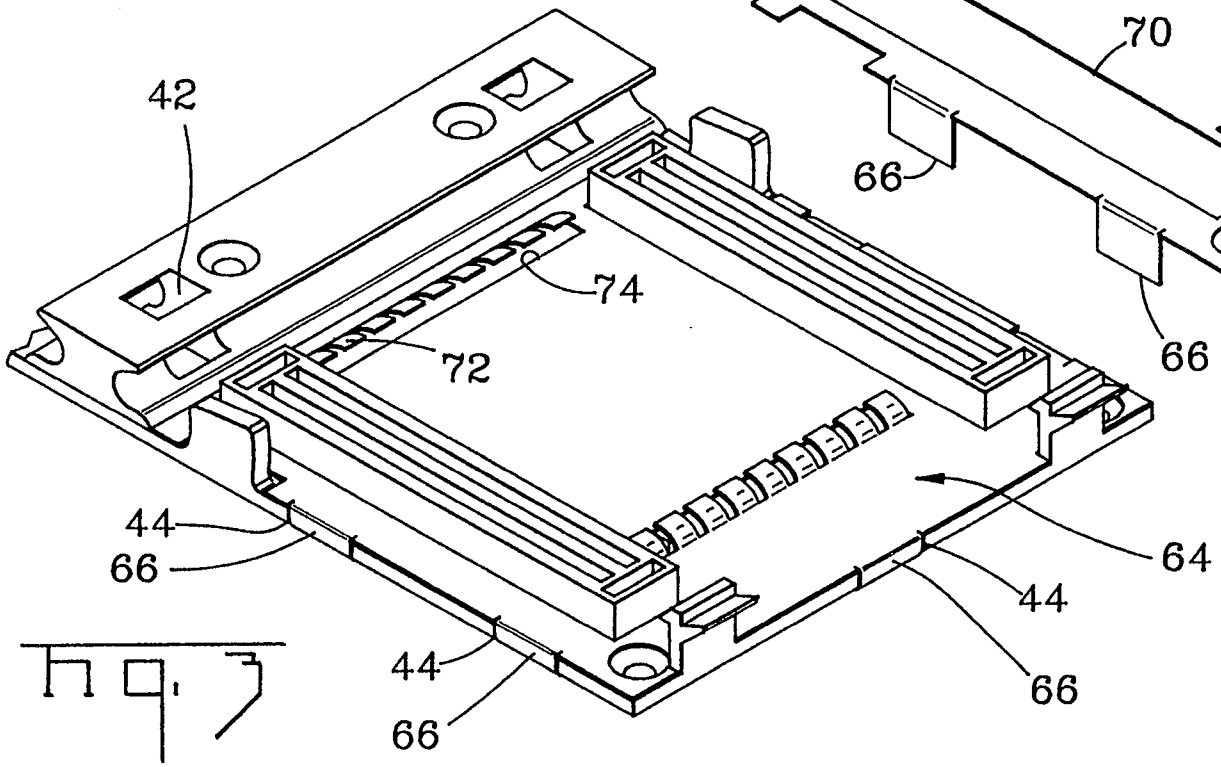
FIG. 3 is a perspective view of an unmounted base assembly upon which the grounding shield member of FIG. 2 has been placed.
Figure 4:
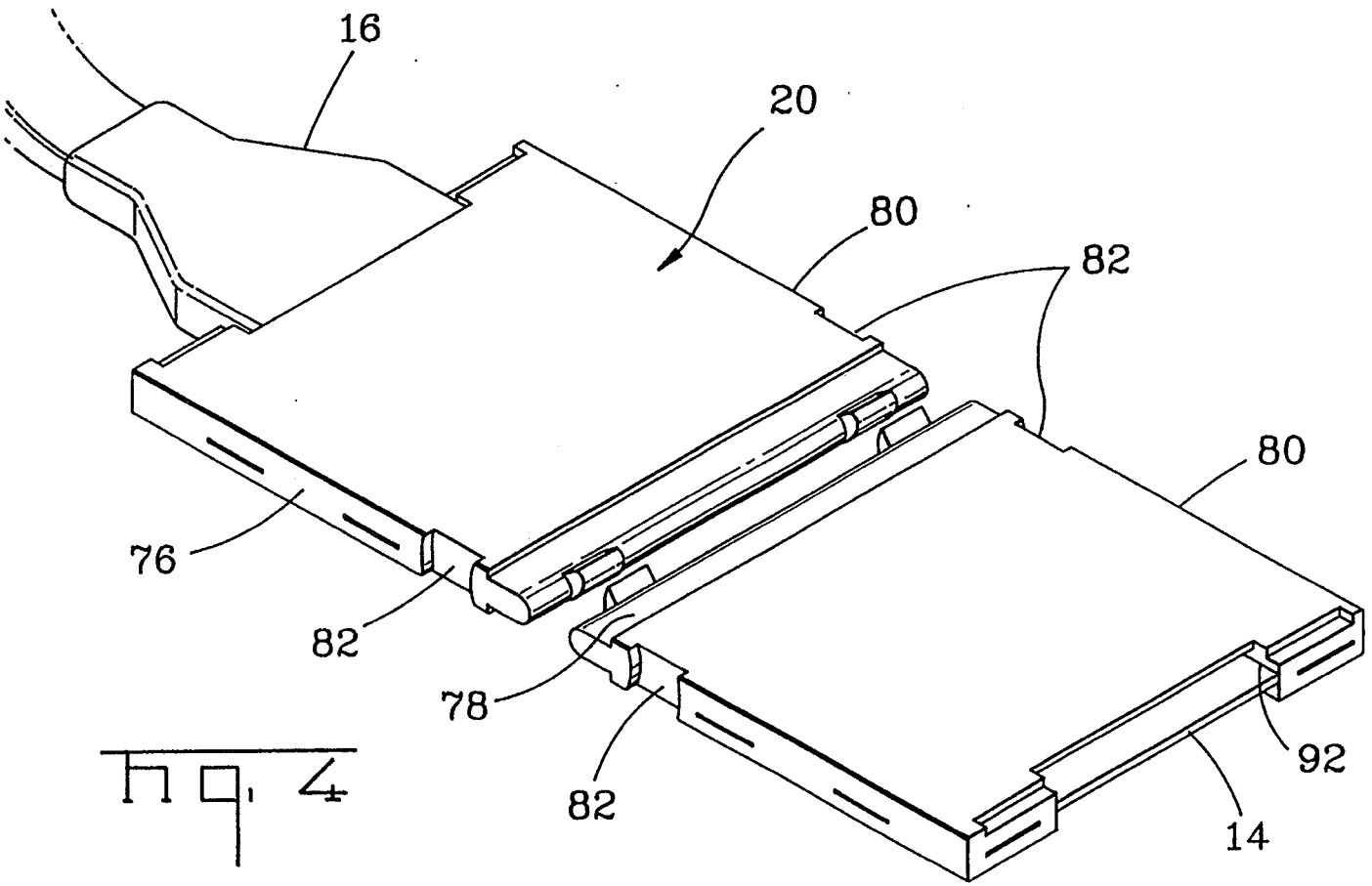
FIG. 4 is a perspective view of a pair of cover members for mating with the base assemblies of FIG. 1.
Figure 11:
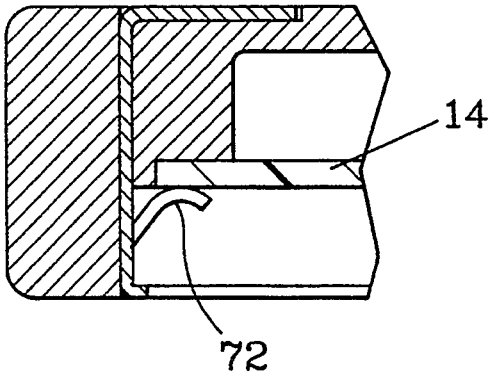
FIG. 11 is an enlarged sectional view showing an exemplary contact of the grounding shield member in supporting contact for a second planar electronic device, such as a daughter board.

A further integral feature of the base assembly 18, illustrated in FIGS. 2 and 3, is a ground shielding member 64, stamped and formed from a sheet metal blank. The ground shielding member 64, as best illustrated in FIG. 2, is an essentially planar member having a plurality of formed edge tabs 66 which are aligned with corresponding recesses 44 in the base assembly 18. When assembled, the edge tabs 66 are formed or bent and underlie the base assembly 18 where they contact corresponding grounding pads on the mother board 12. The ground shielding member 64 may be further provided with a pair of cutouts 70 to receive the pair of contact retaining members 30 so as to lie contiguous with the surface of the base assembly. Finally, upstanding from the ground shielding member are plural contact fingers 72 for a grounding connection to the daughter board 14. Such fingers may be formed by stamping or cutting, then bent in an arcuate configuration along a common edge from tile opening 74. By this arrangement, in the assembled condition, the fingers 72 are biased against and in grounding contact with the daughter board 14, see FIG. 11.

The cover member 20, illustrated in several different perspectives in FIGS. 1, and 4–10, comprises an essentially unitary body, typically formed of metal, consisting of a pair of side members 76, joined together by a transverse hinging member 78, and a top wall 80. Along the outer edge of the respective side members 76 is a curved slot 82 or recess for receiving an alignment guide member 84 projecting from the base 24. The interaction of said slot 82 with said guide member 84 is most apparent in FIGS. 13*a* to 13*d*. As best seen in FIGS. 5 and 6, the transverse hinging member 78 includes a pair of axially extending, curved projections 79 arranged to be aligned with the cavities 42 to be slidably received therein. The manner in which such projections cooperate with the cavities will become apparent hereinafter.

Figure 9:
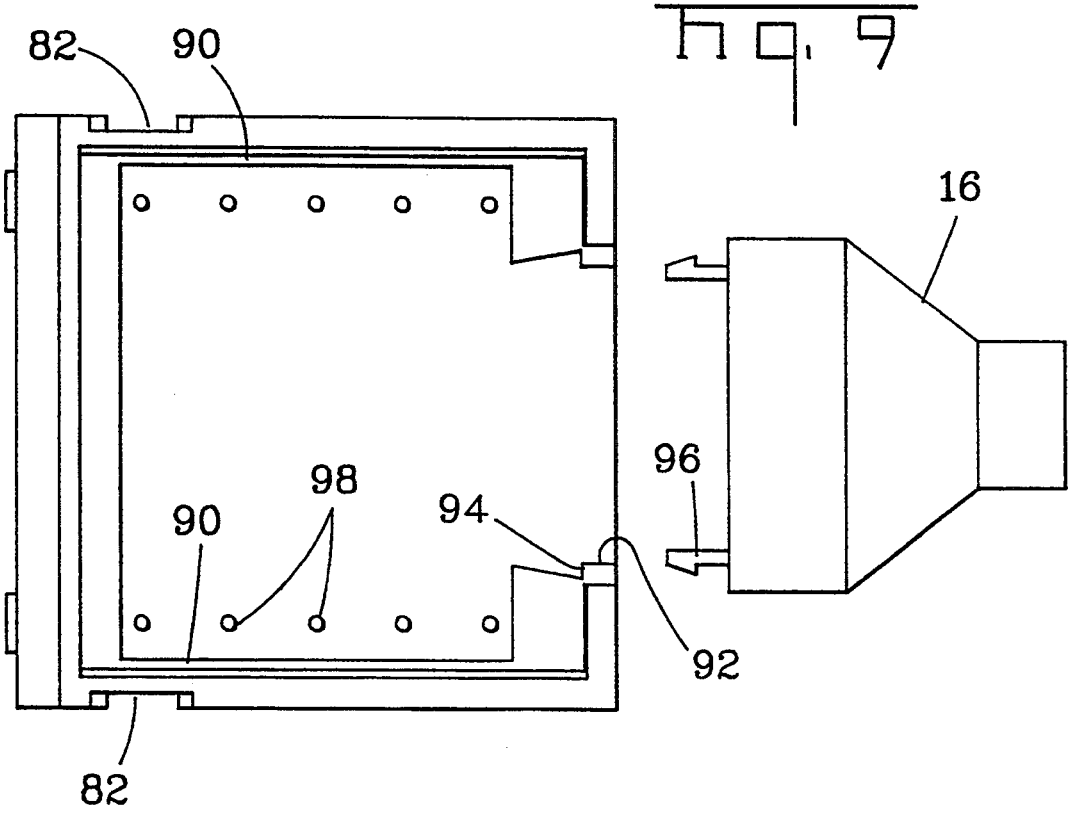
FIG. 9 is a plan view of the inside of the cover member.
Figure 10:
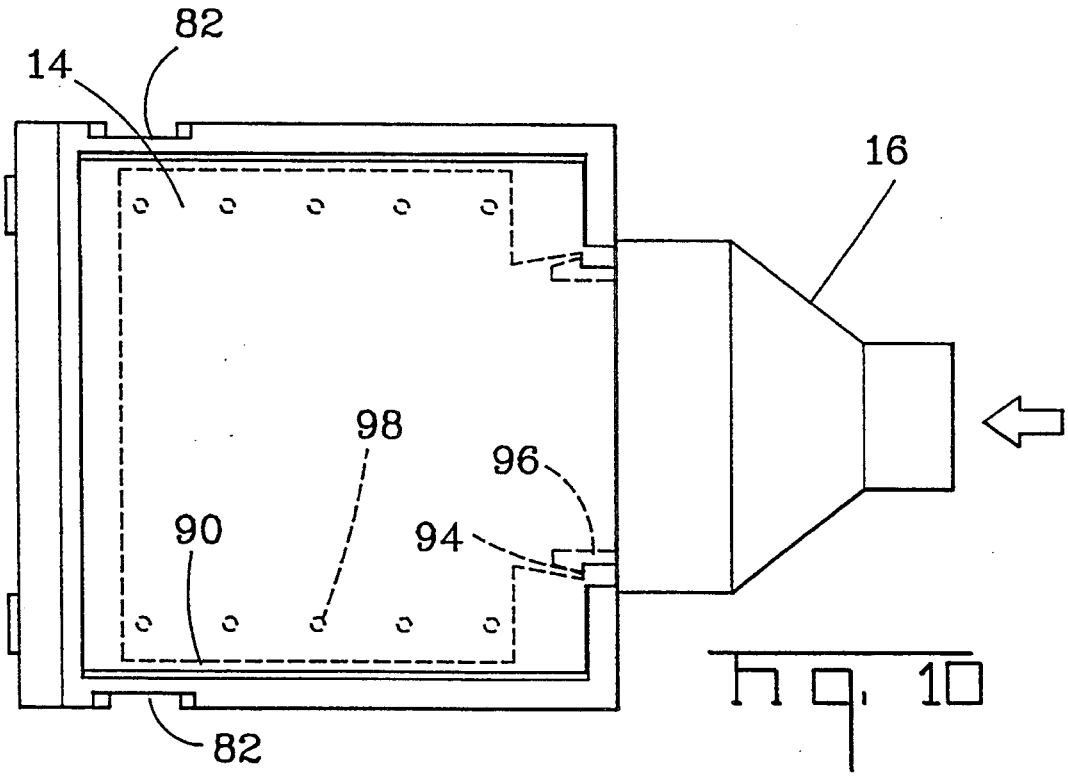
FIG. 10 is a view similar to FIG. 9 showing, in phantomlines, the seating of a planar electronic device, such as a daughter board, within the cover member.

Internally, between the side members 76 and hinging member 78, the cover member 20 includes a shoulder 90, FIGS. 5 to 8, upon which the daughter board 14 resides. As best seen in FIGS. 9 and 10, the shoulder 90, at the I/O connector receiving end 92 of the cover member 20, is provided with a stepped portion 94 to engage latching arms 96 of an I/O connector 16. Extending from the underside of top wall 80, towards the interior thereof, a plurality of aligned support posts 98 are provided to give edge support to the contained daughter board 14.

Turning now to FIGS. 5 and 6 in more detail, and to the sequence of FIGS. 13*a* to 13*d*, it will be seen how the cover member 20 engages the base assembly 18 to effect closing of the connector 10, and the sequential engagement of the flexible film connectors or contacts. To initiate engagement of the cover member 20 to the base assembly, the axially extending projections 79 are inserted at an angle, i.e. about 45°, into the slot 38 and into the cavities 42, note the direction arrows of FIGS. 13*a* and 13*b*. Thereafter, the cover member 20 is pivoted or rotated from a nonparallel position to a position which is parallel to and in latching engagement with the base assembly, FIGS. 6 and 13*d*. During this movement of the cover member 20 into contact and engagement with the latching members 46, the flexible film connector 52*a* nearest to the hinging member 78 electrically interconnect the mother board 12 to the daughter board 14. This connector 52*a* may, by way of example, comprise a ground to the connector 10. Thereafter, the longitudinally aligned flexible film connectors **52*b* (FIGS. 7 and 8) are engaged, where the latter connectors may be signal and power contacts, for example. As the respective members are brought into latching engagement, the contacts 52*c*, which may be detection contacts, complete the circuit bringing the mother board and daughter board into electrical engagement. To effect a disconnection of the connector 10, the latching member 46 has been provided with a release arm 100. By deflecting the arm 100, as illustrated in the direction arrow of FIG. 6, the latching member 46 bends or deflects about its base to free the cover member 20 from the shoulder 48**, thereby freeing the cover member for replacement, repair, etc.

Figure 12:
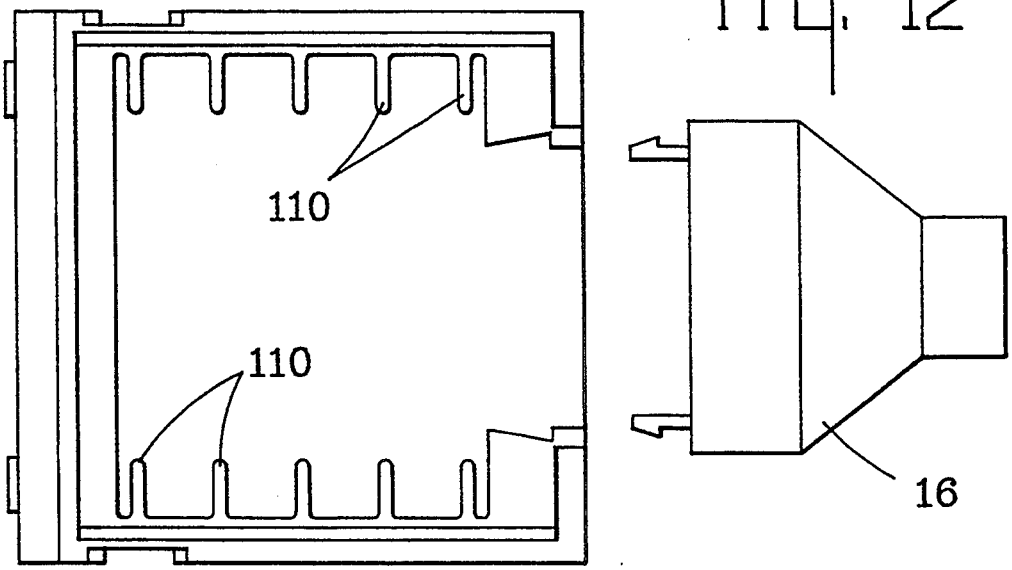
FIG. 12 is a view similar to FIG. 9 showing an alternate arrangement for the daughter board support members.
Figure 14:
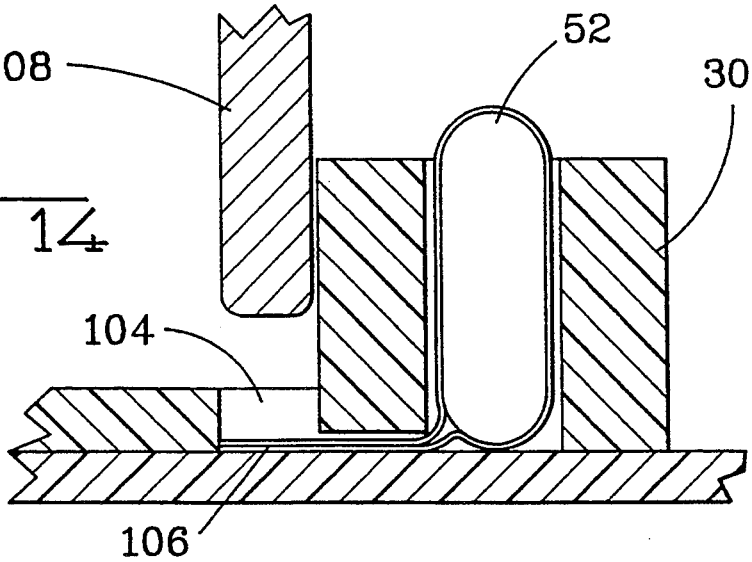
FIG. 14 is an enlarged, partial sectional view illustrating the means for attaching the flexible film connectors to the mother board.
Figure 17A:
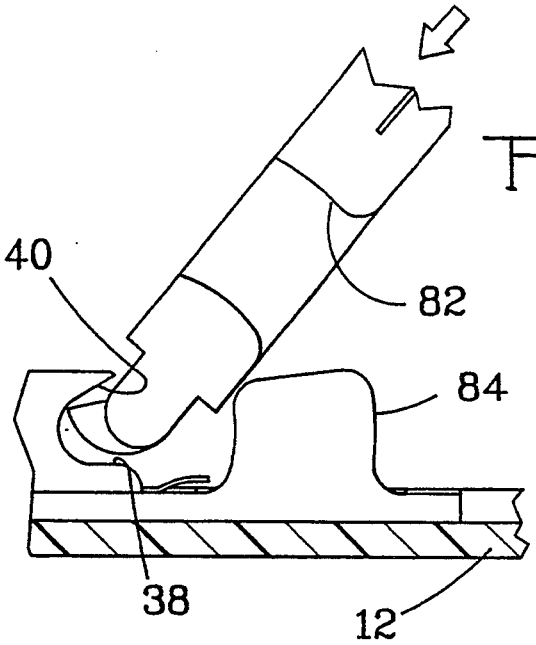
Figure 17B:
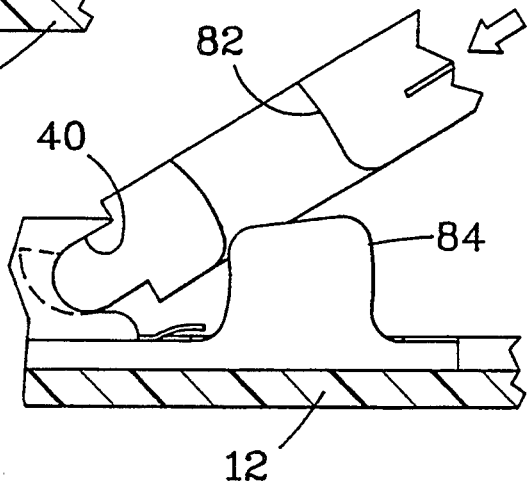
Figure 17C:
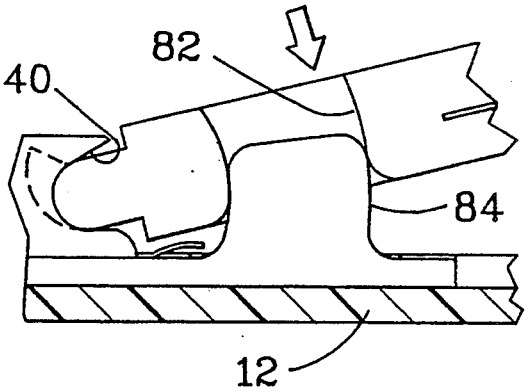
Figure 17D:
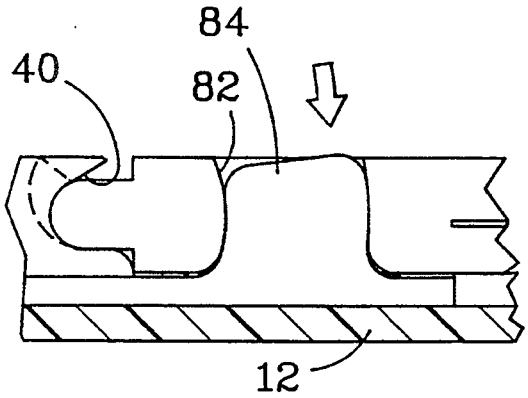

By the use of no more than a pair of parallel flexible film connectors **52*b* (FIG. 8) of the preferred embodiment, such connectors may be secured to the mother board 12 by soldering. As best illustrated in FIG. 14, adjacent the contact housing 30, slots 104 are provided; however, only one is shown in the Figure. The flexible film connector 52 is provided with a tail 106 which lies atop the mother board 12 in communication with the slot 104. By this arrangement, a heated bar may be inserted into the slot 104 to apply localized heating to the tail 106 to effect soldering of the leads from the flexible film connector 52 to corresponding traces or pads on the mother board 12. Where more than two rows of flexible film connectors are used, soldering of such internal connectors are not possible. Further, when using three parallel flexible film connectors, it may be desirable to modify the cover member 20 by the inclusion of a plurality of parallel rib supports 110, as shown in FIG. 12**. The rib supports will help to apply a uniform compressive force against the daughter board in contact with such connectors.

Figure 15:
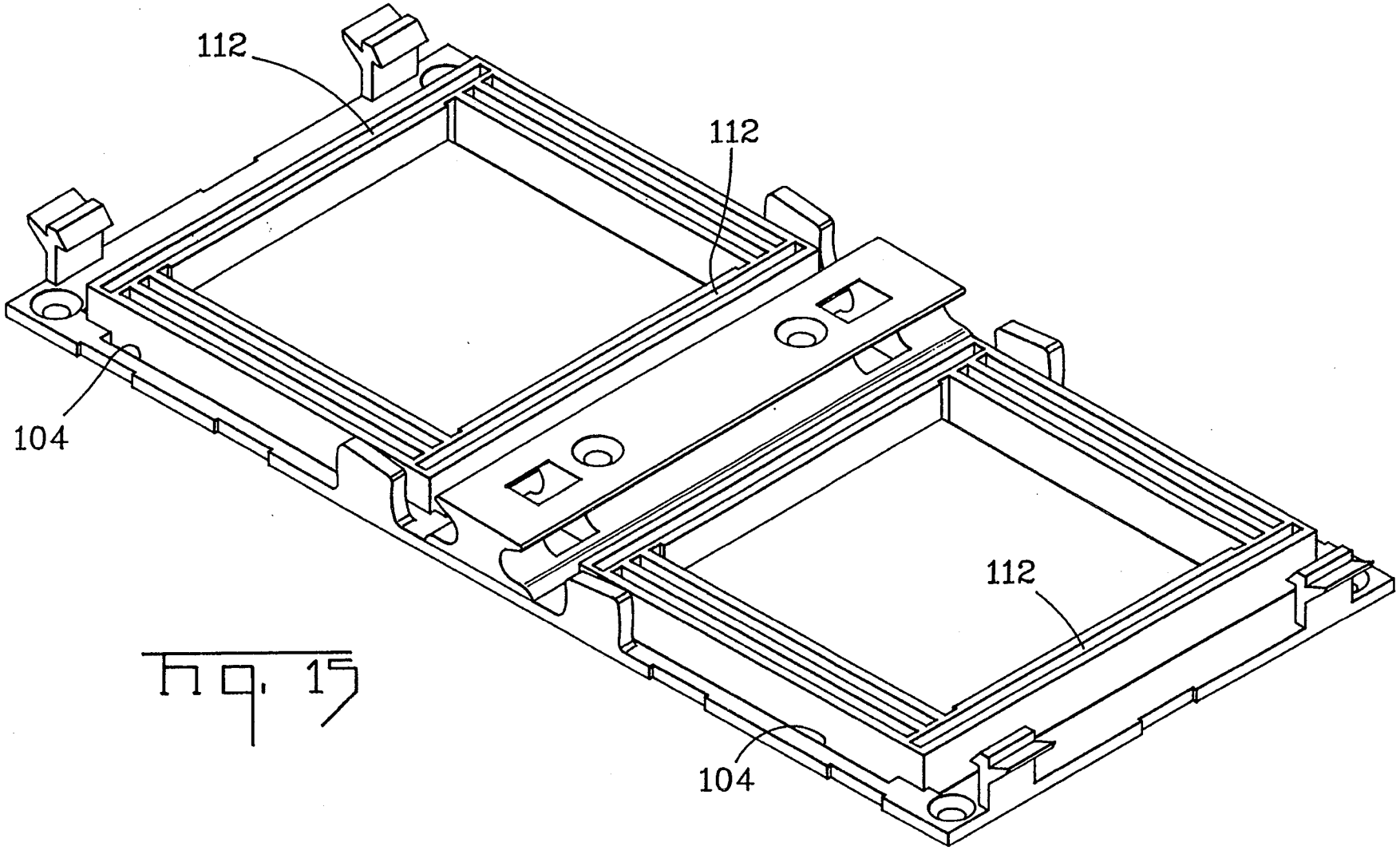
FIG. 15 is a perspective view, similar to FIG. 1, illustrating an alternative embodiment for a connector according to this invention.

FIG. 15 illustrates a modification to the base assembly 18, where a single, transverse flexible film cavity 112 may be provided.

We claim:

1. An electrical connector for sequentially connecting plural contacts provided along the respective mating surfaces of a pair of planar electronic devices, said connector comprising a first housing mounted to one of said planar devices, where said first housing includes an open end and a closed end, and a second housing mounting said other planar electronic device, where said second housing includes an open end, and a closed end, and that said respective closed ends include cooperative means for hingedly engaging each other, said cooperative means including a common pivot line parallel to each said planar electronic device and extending along said closed ends, whereby, as said planar electronic devices are pivotally moved about said cooperative means from a nonparallel position to a parallel position of electrical engagement, the respective plural contacts between said planar electronic devices enter into engagement in a sequentially predetermined order.

2. The electrical connector according to claim 1, including latching means to secure said first and second housings in said parallel position.

3. The electrical connector according to claim 1, including contact retaining means aligned perpendicular to said closed housing ends.

4. The electrical connector according to claim 1, wherein said plural contacts comprise contacts to effect grounding, bring power to the connector, allow signals to be transmitted between said electronic devices, and a detection contact, where the latter contact is the final contact in the mating sequence.

5. The electrical connector according to claim 1, wherein there are a plurality of first housings mounted to a single said planar electronic device, and a like plurality of second housings, each matable with a corresponding first housing.

6. The electrical connector according to claim 1, wherein said first housing includes an EMI shielding member, where said shielding member includes tab members for contacting the underlying planar electronic device.

7. The electrical connector according to claim 3, wherein said second housing includes spaced apart supports aligned with said contact retaining means.

8. The electrical connector according to claim 1, wherein said first and second housings includes cooperative means to effect alignment of said housings in the mated condition.

9. The electrical connector according to claim I, wherein said cooperative means includes an upstanding transverse wall containing a transverse slot for receiving said second housing and a pair of cavities communicating therewith, and second housing includes a pair of curved projections engagable with said cavities.

10. An electrical connector for sequentially connecting plural contacts provided along the respective mating surfaces of a pair of planar electronic devices, said connector comprising a first housing mounted to one of said planar devices, where said first housing includes an open end and a closed end, a second housing mounting said other planar electronic device, where said second housing includes an open end and a closed end, and that said respective closed ends include cooperative means for hingedly engaging each other, and contact retaining means aligned perpendicular to said closed housing ends, where a flexible film containing electrical circuitry thereon is provided in said retaining means, and that said flexible film extends between said electronic devices in the mated position to provide for electrical engagement therebetween, whereby, as said planar electronic devices are pivotally moved about said cooperative means from a nonparallel position to a parallel position of electrical engagement, the respective plural contacts between said planar electronic devices enter into said electrical engagement in a sequentially predetermined order.

11. The electrical connector according to claim 10, including a slot adjacent to said contact retaining means, and said flexible film includes a solder tail extending into said slot, whereby a heater bar may be received in said slot to effect soldering of said solder tail to one of said planar electronic devices.

12. An electrical connector for sequentially connecting plural contacts provided along the respective mating surfaces of a pair of planar electronic devices, said connector comprising a first housing mounted to one of said planar devices, where said first housing includes an open end and a closed end, and a second housing mounting said other planar electronic device, where said second housing includes an open end and a closed end, and that said respective closed ends include cooperative means for hingedly engaging each other, said second housing further including means along said open end thereof for electrically engaging an I-O connector to said planar electronic device mounted in said second housing, whereby, as said planar electronic devices are pivotally moved about said cooperative means from a nonparallel position to a parallel position of electrical engagement, the respective plural contacts between said planar electronic devices enter into engagement in a sequentially predetermined order.

* * * * *